United States Patent [19]

Aldridge et al.

[11] 4,361,219

[45] Nov. 30, 1982

[54] SWIVELLING ARRANGEMENTS

[75] Inventors: William R. Aldridge; Stanley Walmsley, both of Wigan, England

[73] Assignee: Coal Industry (Patents) Limited, London, England

[21] Appl. No.: 180,566

[22] Filed: Aug. 25, 1980

[30] Foreign Application Priority Data

Sep. 28, 1979 [GB] United Kingdom ..... 7933802

[51] Int. Cl.[3] ..... B65G 21/10; B65G 65/02

[52] U.S. Cl. ..... 198/315; 74/96; 198/317; 198/587; 280/137; 414/695.6

[58] Field of Search ..... 198/315–317, 198/387, 391, 865; 299/43, 64; 74/96; 474/141; 37/89, 96; 212/246; 414/695.6; 280/137

[56] References Cited

U.S. PATENT DOCUMENTS

| | | | |
|---|---|---|---|
| 2,661,834 | 12/1953 | Bergmann | 198/591 |
| 2,933,294 | 4/1960 | Meehan | 299/64 |
| 3,547,287 | 1/1969 | Cunningham | 198/317 X |

FOREIGN PATENT DOCUMENTS

| | | |
|---|---|---|
| 500649 | 2/1939 | United Kingdom . |
| 515029 | 11/1939 | United Kingdom . |
| 674626 | 4/1948 | United Kingdom . |
| 835432 | 5/1965 | United Kingdom . |
| 1355597 | 6/1974 | United Kingdom . |
| 1462213 | 1/1977 | United Kingdom . |
| 1556157 | 11/1979 | United Kingdom . |

*Primary Examiner*—John J. Love
*Assistant Examiner*—Douglas D. Watts
*Attorney, Agent, or Firm*—Stevens, Davis, Miller & Mosher

[57] ABSTRACT

A swivelling arrangement for controlling relative angular movement between two components comprises a yoke pivotally mounted on one of the components and pivotally movable under the action of a ram. The yoke has two limbs to the radially outermost ends of which are fixedly secured the ends of a drive chain arranged drivably to engage a drive sprocket fixedly secured to other of the components.

7 Claims, 4 Drawing Figures

SWIVELLING ARRANGEMENTS

This invention relates to swivelling arrangements.

In particular, although not exclusively, the present invention relates to swivelling arrangements for use on mining equipment, for examples, swivelling arrangement for controlling the angular position of a discharge conveyor relatively to the body of a machine upon which the conveyor is mounted.

It is known for the angular position of a discharge conveyor on a mining machine to be controlled by a pair of co-acting rams located on opposite sides of the conveyor and each connected between the conveyor and the body of the mining machine. Unfortunately, with such a prior known arrangement the maximum angular adjustment is dependent upon the maximum extention of the rams. Consequently, in order to achieve a desired wide angular adjustment it was necessary to employ long rams which tended to be expensive and liable to damage.

An object of the present invention is to provide a swivelling arrangement which is suitable for use with a mining machine discharge conveyor and which tends to overcome or reduce the problems encounted with the prior known arrangements.

According to the present invention, a swivelling arrangement for controlling relative angular movement between two components comprises a ram securable to one of the components and to a yoke having two limbs and pivotally securable to said one component for pivotal movement under the action of the ram, and a drive member fixedly attached to the limbs of the yoke and arranged to drivably engage a pivotable driven member fixedly securable to the other of the two components such that the pivotal axis of the driven member is coaxial with the axis of relative angular movement between the two components.

Preferably, the drive member is a chain and the driven member is a sprocket.

Advantageously, the limbs are located on one side of the sprocket and the chain is arranged around the sprocket.

Advantageously, the ram is pivotally secured to a third limb of the yoke.

Conveniently, the third limb is shorter than said two limbs.

The present invention provides an excavating machine comprising a body component, a discharge conveyor component pivotally mounted on the body and a swivelling arrangement for controlling relative angular movement between the two components, the swivelling arrangement comprising a ram securable to one of the components and to a yoke having two limbs and pivotally secured to said one component for pivotal movement under the action of the ram, and a drive member fixedly attached to the limbs of the yoke and arranged to drivably engage a pivotable driven member fixedly secured to the other of said components such that the pivotal axis of the driven member is co-axial with the axis of relative angular movement between the two components.

Preferably, said one of the components is the body component and the other of the two components is the discharge conveyor component.

Advantageously, the drive member is a chain and the driven member is a sprocket.

Preferably, the discharge conveyor component is pivotable about a shaft.

Preferably, the discharge conveyor component is supported on a slewing ring.

Conveniently, the ram is pivotally secured to said one component.

By way of example only, one embodiment of the present invention will be described with reference to the accompanying drawings, in which.

Figure 1:
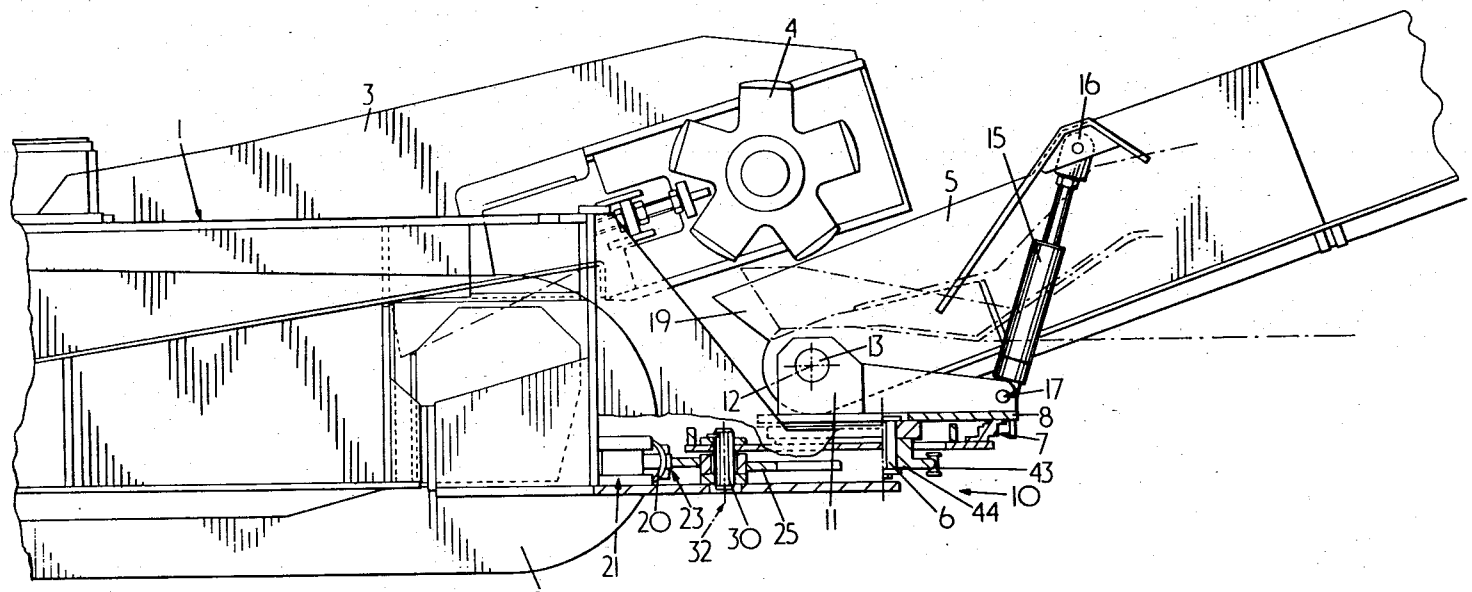
FIG. 1 is an incomplete side elevation drawn partly in section of the rear of a mining machine comprising a swivelling arrangement constructed in accordance with the present invention.

The drawings show a rear portion of a mineral excavating machine as used in an underground mine for excavating rock or mineral to extend roadways in the mine. The machine comprises a body 1 mounted on crawler tracks 2 and having a main discharge conveyor 3 (omitted in FIGS. 2 and 3) driven by a hydraulic motor 4 and extending longitudinally of the machine to convey broken material excavated by cutter means (not shown) provided on a front portion of the machine towards a second discharge conveyor 5 which is angularly movable relatively to machine body and which is supported for pivotal movement about vertical shaft 6 by a slewing ring assembly 7, the upper horizontal plate 8 of which constitutes a rotatable platform for the conveyor 5. The plate 8 is partly cut away in FIG. 2 to expose a swivelling arrangement 10 for controlling relative angular movement between the machine body and the discharge conveyor 5.

A turret 11 (see FIG. 1) fixedly secured on the plate 8 supports the discharge conveyor 5 for pivotal movement about a substantially horizontal axis 12, the conveyor being carried on a shaft 13 which rotatably engages in the turret mounting and which permits the discharge end of the conveyor 5 (not shown in the drawings) to be raised or lowered under the action of a ram 15 pivotally engaged in mountings 16 and 17 provided on the conveyor 5 and on the plate 8, respectively. The end of the conveyor 5 shown in the drawings is provided with a chute arrangement 19 for receiving broken material discharged from the overhead delivery end of the main discharge conveyor 3.

Figure 2:
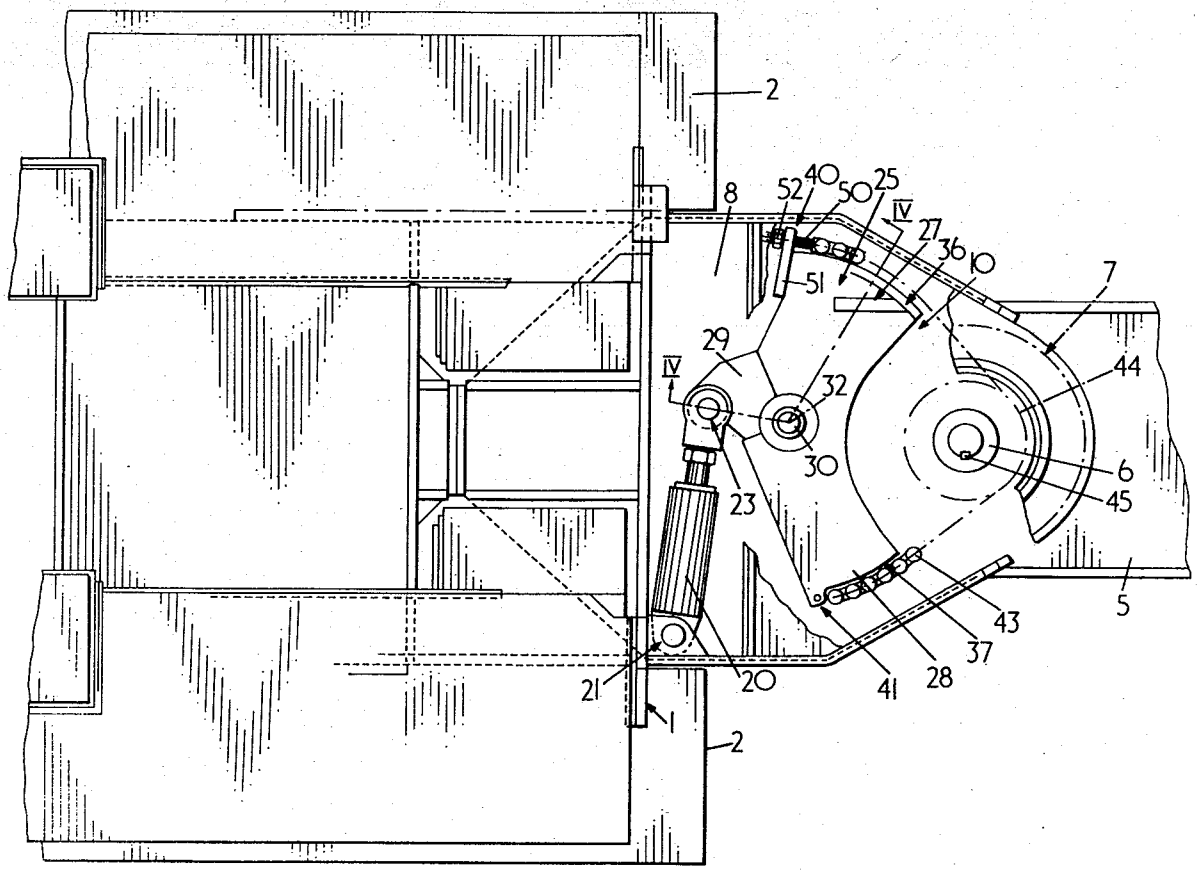
FIG. 2 is an incomplete plan of FIG. 1 and drawn partly in section.
Figure 3:
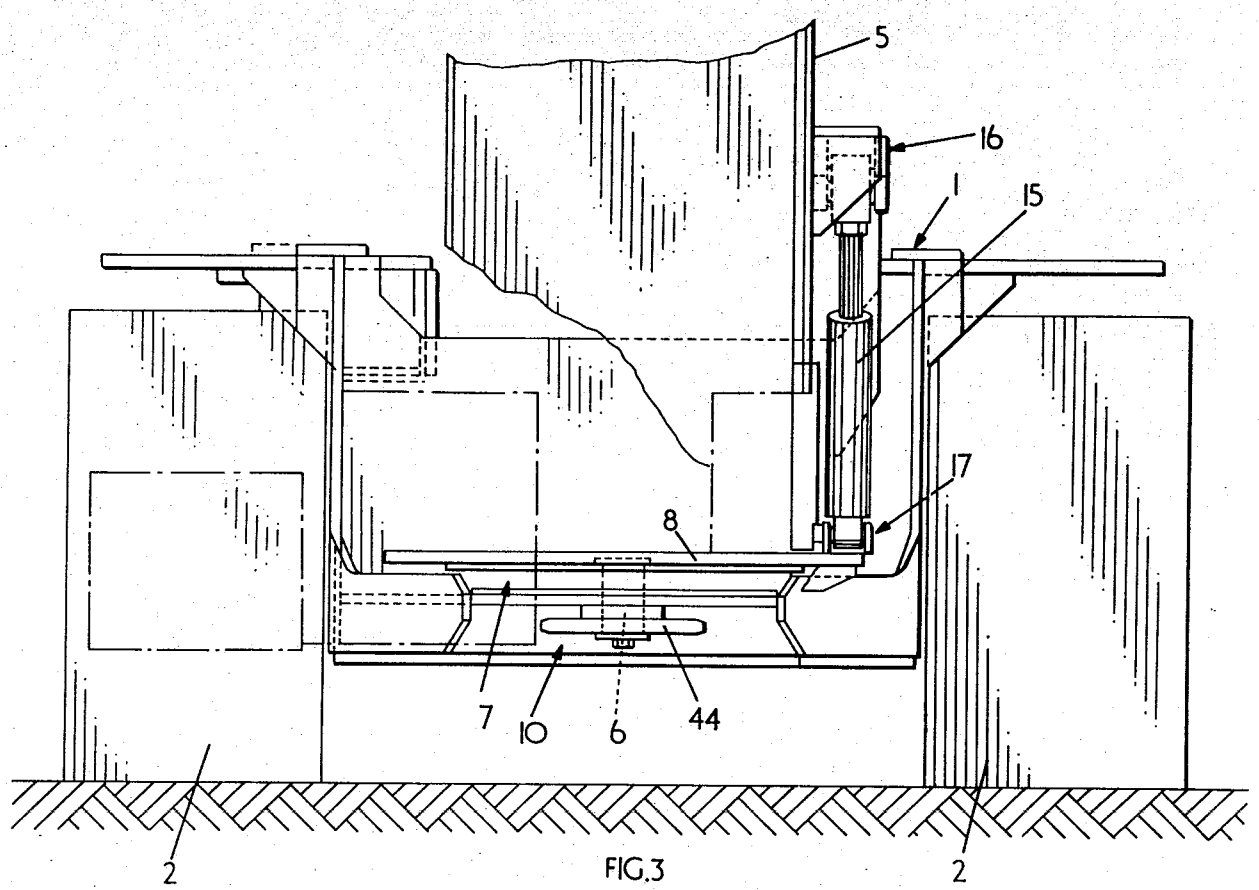
FIG. 3 is an incomplete rear view of FIG. 1.
Figure 4:
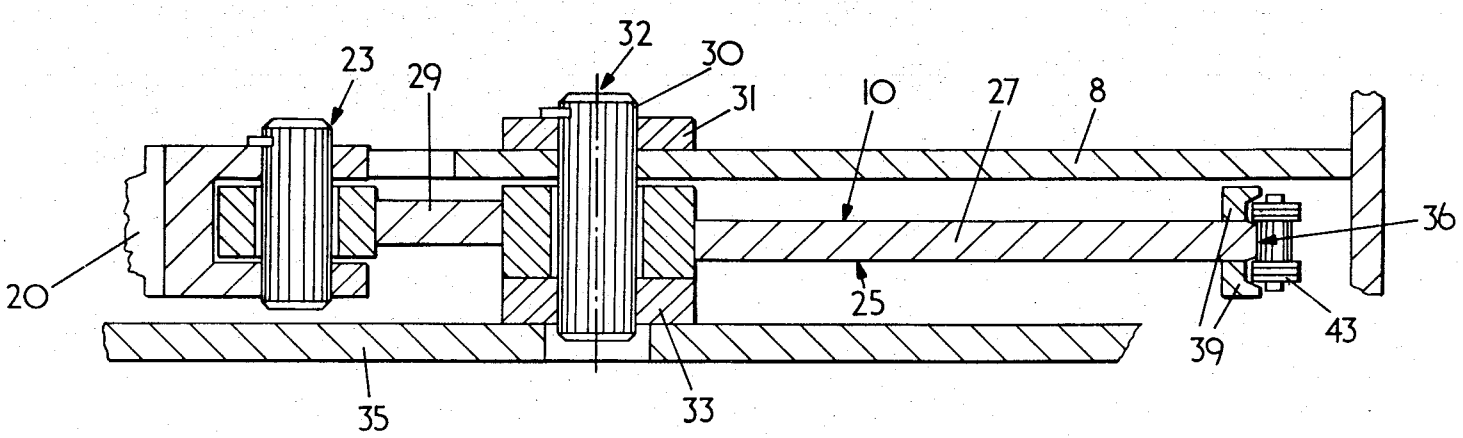
FIG. 4 is a sectional view along line IV—IV of FIG. 2, the sectional view being drawn on an enlarged scale.

The previously mentioned swivelling arrangement 10 comprises a ram 20 secured in pivotal mountings 21 and 24 provided on the machine body 1 and a pivotally supported yoke 25 having two relatively long limbs 27 and 28 and a relatively short third limb 29 which carries the pivotal mounting 23 for the ram 20. The yoke is pivotal mounted about an axis 32 on a shaft 30 rotatably mounted in bearings 31 and 33 provided on the upper platform plate 8 and on a lower support plate 35 extending beneath and parallel to the plate 8. The radially outermost faces 36 and 37 of the two limbs 27 and 28, respectively are curved for a reason which will be made clear later in this specification. The outermost end margins of the two limbs 27 and 28 are provided with anchor mountings 40 and 41 for a length of flexible chain 43 which extends between the two anchor mountings 40 and 41 and which constitutes a drive member for a driven sprocket 44 fixedly mounted by a key 45 on the shaft 6 about which the discharge conveyor 5 angularly moves relative to the machine body. As seen in FIG. 2 the two limbs 27 and 28 are located on one side of the driven sprocket 44 so the drive chain 43 passes around the sprocket, the ends of the chain being guided around the curved radially outermost faces 36 and 37 of the two limbs 27 and 28. As seen in FIG. 4 chain support flanges 39 are provided on the radially outer margins of the relatively long limbs. The anchor mounting 40 comprises a screwed rod 50 fixedly secured to the adjacent end of the drive chain 43 and passing through a bore formed in a radially extending bracket 51, the screwed rod being engaged by a nut 52 adjustment of which varies the chain tension.

The radial distance from the pivotal axis 32 of the shaft 30 to the pivotal mounting 23 for the ram 20 is less than the radial distance from the pivotal axis 32 of the shaft 30 to the radially outermost curved face 36 and 37 of the two relatively long limb 27 and 28 so that any movement of yoke 25 caused by a change in the length of the ram 20 is magnified at the radially outermost margins of the two relatively long limbs 27 and 28. Thus for a given change in ram extension the driven chain is moved a proportionally greater distance. Thus, a relatively small change in the length of the ram 20 causes the drive chain to drivably rotate the driven sprocket by a relatively large amount. Consequently, with the swivelling arrangement of the present invention it is possible to adjust the angular position of the discharge conveyor 5 relative to the machine by desirably relatively large amounts, the swivelling arrangement requiring only a single relatively short ram 20.

It will be appreciated that the swivelling arrangement is robust, simple and relatively inexpensive.

In operation, the machine excavates rock or mineral to extend the underground roadway, the broken material being conveyed from the region of the cutter head by the main discharge conveyor 3 which discharges the material into the chute arrangement 19 which loads the material onto the second discharge conveyor 5 which, in turn feeds the broken material towards further conveyor means (not shown) provided outbye of the excavating machine. The further conveyor means, for example, may comprise a belt conveyor or a train of mine cars. As the position of the excavating is adjusted to enable different parts of the working rock or mineral face to be excavated the angular position of the discharge conveyor 5 relative to the machine body is adjusted by suitable actuation of the swivelling arrangement 10 so that the broken material is constantly fed to the receiving station of the further conveyor means and substantially no spillage of material occurs.

With the swivelling arrangement 10 as constructed in the drawings it is possible to slew the discharge conveyor 5 relative to the machine body through an angle of 120°, ie 60° either side of the inline position. Such a maximum slewing angle is suitable for most excavating machine installations.

It will be appreciated that the construction of swivelling arrangement 10 as described above has the advantages that it only requires a single relatively short ram. The arrangement takes up a relatively small space which is important in an underground excavating machine required to operate in confined working conditions. In addition, the driving force exerted by the yoke on the drive chain substantially is constant throughout the full range of operational movement.

It will be appreciated that the swivelling arrangement according to the present invention is suitable for use in installations other than underground excavating machines, it can be used wherever it is desired to control relative angular movement between two components.

We claim:

1. A swivelling arrangement for controlling relative angular movement between two components, comprising a ram secured to one of the components and to a first limb of a yoke; said yoke having three limbs and being pivotally secured to said one component for pivotal movement under the action of the ram; a drive member fixedly attached to second and third limbs of the yoke and arranged to drivably engage a pivotable driven member fixedly secured to the other of the two components such that the pivotal axis of the driven member is co-axial with the axis of relative angular movement between the two components, said first limb being shorter than said second and third limbs.

2. An arrangement as claimed in claim 1, in which the drive member is a chain and the driven member is a sprocket.

3. An arrangement as claimed in claim 2, in which said second and third limbs are located on one side of the sprocket and the chain is arranged around the sprocket.

4. An excavating machine comprising a body and, a discharge conveyor pivotally mounted on the body and a swivelling arrangement for controlling relative angular movement therebetween, the swivelling arrangement comprising a ram secured to the body and to a first limb of a yoke having three limbs and being pivotally secured to the body for pivotal movement under the action of the ram; a drive member fixedly attached to second and third limbs of the yoke and arranged to drivably engage a pivotable driven member fixedly secured to the discharge conveyor such that the pivotal axis of the driven member is co-axial with the axis of relative angular movement between the body and the discharge conveyor, said first limb of the yoke being shorter than said second and third limbs.

5. A machine as claimed in claim 4, in which the drive member is a chain and the driven member is a sprocket.

6. A machine as claimed in claim 4, in which the discharge conveyor is pivotal about a shaft.

7. A machine as claimed in claim 6, in which the discharge conveyor is supported on a slewing ring.

* * * * *